United States Patent [19]

Uchida et al.

[11] 4,175,964

[45] Nov. 27, 1979

[54] METHOD OF MAKING A LITHOGRAPHIC PRINTING PLATE

[75] Inventors: Toshio Uchida; Yorimiti Yabuta; Teppei Ikeda, all of Asaka, Japan

[73] Assignee: Fuji Photo Film Co., Ltd., Minami-ashigara, Japan

[21] Appl. No.: 804,481

[22] Filed: Jun. 7, 1977

[30] Foreign Application Priority Data

Jun. 7, 1976 [JP] Japan ..... 51-66353

[51] Int. Cl.[2] ..... G03C 11/12; G03C 5/00; G03C 1/94

[52] U.S. Cl. ..... 430/253; 204/35 N; 204/38 A; 430/258; 430/260; 430/286; 430/306; 430/496; 430/636

[58] Field of Search ..... 96/29, 35.1, 86 P, 86 R, 96/67; 204/38 A, 35 N

[56] References Cited

U.S. PATENT DOCUMENTS

| | | | |
|---|---|---|---|
| 3,607,264 | 9/1971 | Celeste et al. | 96/28 |
| 3,620,726 | 11/1971 | Chu et al. | 96/28 |
| 3,715,211 | 2/1973 | Quaintance | 96/86 P |
| 3,754,920 | 8/1973 | Kuchta | 96/87 R |
| 3,770,438 | 11/1973 | Celeste | 96/28 |
| 3,785,817 | 1/1974 | Kuchta | 95/35.1 |
| 3,860,426 | 1/1975 | Cunningham et al. | 96/86 P |
| 3,873,318 | 3/1975 | Sheasby et al. | 96/86 P |
| 3,877,939 | 4/1975 | Okai | 96/86 P |
| 3,891,441 | 6/1975 | Tsuji et al. | 96/35.1 |

*Primary Examiner*—Jack P. Brammer
*Attorney, Agent, or Firm*—Sughrue, Rothwell, Mion, Zinn and Macpeak

[57] ABSTRACT

A light-sensitive lithographic printing plate element suitable for the formation of negative and positive images, simultaneously, comprising a hydrophilic support having, in succession, a light-sensitive composition layer and a transparent cover film in which images for printing are formed by imagewise exposing through the cover film and peeling apart to remove, together with the cover film, the areas having a stronger adhesion to the cover film in the light-sensitive composition layer by utilizing the difference in adhesion to the support and to the cover film between the exposed areas and the unexposed areas of the light-sensitive composition layer, whereby the areas of the light-sensitive composition layer having a stronger adhesion to the support remain on the support, wherein the surface of the support adjacent the light-sensitive composition layer is treated with an aqueous solution containing at least one water soluble oxygen acid or water soluble oxygen acid salt selected from the group consisting of boric acid, boric acid salts, molybdic acids, molybdic acids salts, phosphoric acids, phosphoric acid salts, vanadic acids, vanadic acid salts, tungstic acids, tungstic acid salts, chromic acid, chromic acid salts, silicic acids and silicic acid salts.

14 Claims, No Drawings

METHOD OF MAKING A LITHOGRAPHIC PRINTING PLATE

BACKGROUND OF THE INVENTION

1. Field of the Invention

The present invention relates to a light-sensitive lithographic printing plate element, and more particularly, to a light-sensitive lithographic printing plate element comprising a support having thereon a layer of a light-sensitive composition whose adhesion to the support varies upon exposure which is capable of forming an image for lithographic printing by peeling apart development.

2. Description of the Prior Art

Recently, numerous investigations on the preparation of lithographic printing plates have been made and the efficiency of lithographic printing plates produced have been remarkably improved. In particular, the marked improvement of lithographic printing plates in printability and press life has resulted in a change from relief printing used in the past to lithographic printing. Reasons resulting in such a situation are based on various advantages that lithographic printing plates recently have enabled a vast amount of printing to be accomplished due to improvements in printability, the facility with which the plate can be produced and used, the period of time for preparing a printing plate is extremely short, and lithographic printing plates have excellent development stability and plate reproducibility, and in addition, lithographic printing plates have good shelf-life, and the like.

Various lithographic printing plate elements are known in the art. The advantages as mentioned above are achieved in particular with a light-sensitive printing plate element using a photopolymer as a light-sensitive layer.

Typical photopolymers used in these printing plates include a photopolymer mainly composed of a photocrosslinkable type light-sensitive resin which is exemplified by, for example, a polyester or p-phenylene diacrylate and 1,4-cyclohexane diol as described in Belgian Pat. No. 696,533, the reaction products of a phenoxy resin and cinnamic acid or a carboxylic acid having unsaturated groups as described in U.S. Pat. No. 3,387,976, etc. Further, a system comprising as a main component a photopolymerizable material represented by the combination of, for example, diethylene glycol diacrylate, triethylene glycol dimethacrylate, pentaerythritol triacrylate, etc., and a binder such as a resin, e.g., a methyl methacrylate/methacrylic acid copolymer, a styrene/itaconic acid copolymer, etc., is known.

Light-sensitive lithographic printing plates which comprise a coating of these photopolymers are imagewise exposed through an original having a desired negative image and then developed with an appropriate developing solution such as an organic solvent, an alkaline aqueous solution, etc., whereby the areas hardened by irradiation with ultraviolet light remain on the support of the plate and the unexposed areas are dissolved out and removed with the developing solution, and thus a master pattern or dots for printing are formed on the plate support to produce lithographic printing plates.

However, the above-described solution-development type lithographic printing plate elements are becoming extremely disadvantageous not only because complicated treatment steps are required because a developing solution must be used, but also from a viewpoint of sanitary working conditions, hazards, air pollution and environmental pollution which might arise in discharge of waste liquids such as alkali solutions or organic solvents, e.g., developing solutions.

Recently, recording elements which can be developed in a dry manner have been proposed instead of printing plate elements requiring solution development. Of such elements, those as described in Japanese Patent Publication 9663/64, Japanese Patent Publication 22901/68, Japanese Patent Application (OPI) 7728/72 and Japanese Patent Application (OPI) 46315/75 utilize the photopolymerizable property of a photopolymer and the change thereof in adhesion. According to this approach, in general, a layer of a photopolymerizable composition containing as main components a polymer as a binder, an unsaturated monomer and an initiator for photopolymerization is provided on a support such as a synthetic resin film, a metal, paper, etc., and a thin transparent film is further superposed thereon as a cover. The method of making a printing plate using such a light-sensitive printing plate comprises exposing the element through an original and the cover and then peeling apart the cover, whereby either one of the exposed areas and unexposed areas on the light-sensitive layer remains on the support and the other remains on the cover. Thus, a negative image and a positive image (or a positive image and a negative image) are formed simultaneously on the support and on the cover, respectively.

However, in light-sensitive elements of the type which are developed by peeling apart the cover film after exposure, where a hydrophilic support for a lithographic printing plate is provided in direct contact with a layer of a light-sensitive composition in accordance with the conventional technique, the following disadvantages occur.

(1) Upon the formation of an image, after imagewise exposure, by peeling apart the areas having stronger adhesion to the cover film on a light-sensitive layer, together with the cover film, a part of the areas to be peeled apart together with the cover film remains on the hydrophilic support. Where such is then used as a printing plate for lithographic printing, printing ink adheres even to the non-image areas so that the non-image areas on the printed material obtained are scummed and thus it is not practically usable. This phenomenon appears to a marked extent in a so-called negative type light-sensitive material in which an image is formed by peeling apart, after imagewise exposure, the unhardened areas of the light-sensitive layer which are not exposed, together with the cover film to remove them and leaving the exposed hardened areas on the support. In this case, scumming is due to the partial adherence of the unhardened areas to the hydrophilic support.

(2) Because an oleophilic light-sensitive composition is directly provided onto a hydrophilic support, the light-sensitive composition layer has poor stability with the passage of time depending upon the kind of components contained in the light-sensitive composition. Several weeks after the preparation, it is sometimes difficult to obtain a normal image by peeling-apart development.

(3) When a peeling-apart development type lithographic printing plate is stored for a long period of time, innumerable "scum-like spots" are often formed at the non-line image areas after imagewise exposure and peeling-apart development. This is believed to be because, since the peeling-apart development type light-sensitive composition contains hydrophobic liquid components such as ethylenically unsaturated monomers, etc., in most cases, liquid components such as monomers, etc., these components permeate into the grains or pores on the surface of the hydrophilic support for lithography with the passage of time and cause countless spot-like scum areas on the surface of the hydrophilic support where the composition is applied to the hydrophilic support. The non-line image areas should essentially be hydrophilic, but the non-line image areas on which such scum are formed are no longer hydrophilic. Upon printing, heavy scumming (scumming over the entire area) occurs so that it is unsuitable for use as a lithographic printing plate.

With respect to (1) above, when the light-sensitive composition remains even on the non-image areas, such is a serious defect since a basic and necessary requirement from the viewpoint of efficient use of lithographic printing plates is for the non-image areas to possess a hydrophilic surface.

With respect to (2) above, light-sensitive lithographic printing plate elements which have poor stability with the passage of time are by no means practical.

With respect to (3) above, after extensive studies on peeling-apart development type light-sensitive lithographic printing plates were conducted, it was found no special problem arose with a peeling-apart type lithographic printing plate where liquid components had permeated into the grains or pores on the surface of the hydrophilic support, from the standpoint of the formation of desired line images for printing using the so-called peeling-apart development which comprises normal imagewise exposure and removing the unexposed areas together with a peeling-apart sheet. What is a problem, however, is spot-like scum areas which are present on the non-line image areas after peeling-apart development. Where this printing plate is to be used for printing, heavy scumming occurs so that the printing plate is not practically usable. In addition, it is extremely difficult to remove the liquid components which have permeated into the support with any known counter-etch solution or surface treating solution for lithographic printing once the aforementioned liquid components permeate into the grains or pores on the surface of the hydrophilic support.

In any lithographic printing plate, an important characteristic which the lithographic printing plate should have is for the printing plate to be resistant to scumming in the background areas (hereinafter background) or scumming in the non-line image areas, i.e., scumming. Even if no scumming is observed immediately after preparation of the printing plate but such becomes scummed after a period of time has lapsed after preparation, the plate cannot be employed practically.

SUMMARY OF THE INVENTION

As a result of detailed investigations to eliminate the above-described defects, it has now been found that, in a light-sensitive element of a structure obtained by a process which comprises treating the surface of a hydrophilic support with an aqueous solution of at least one water soluble oxygen acid or water soluble oxygen acid salt selected from the group consisting of boric acid, boric acid salts, molybdic acids, molybdic acid salts, phosphoric acids, phosphoric acid salts, vanadic acids, vanadic acid salts, tungstic acids, tungstic acid salts, chromic acid, chromic acid salts, silicic acids and silicic acid salts to provide a new hydrophilic layer, coating further thereon a layer of a photohardenable light-sensitive resin composition, and laminating additionally thereon a cover film, the unhardened areas which were not removed upon peeling-apart development subsequently after imagewise exposure are completely peeled apart together with the cover film without the unhardened areas remaining on the layer treated with the aqueous solution of the oxygen acid salt(s). This phenomenon has also been found to be applicable when other metals are employed as a hydrophilic support and when a light-sensitive resin composition layer containing a positive image is present, thus the present invention has been accomplished.

Accordingly, an object of the present invention is to provide a light-sensitive lithographic printing plate element in which an image is formed by utilizing the difference in adhesion between the photohardened areas and the unhardened areas of a light-sensitive composition layer to a hydrophilic support.

Another object of the present invention is to provide a light-sensitive lithographic printing plate element in which an image is formed by utilizing the difference in adhesion between the exposed areas and the unexposed areas in a light-sensitive composition layer after imagewise exposure.

A further object of the present invention is to provide a light-sensitive lithographic printing plate element in which no light-sensitive composition remains at the non-image areas upon peeling-apart development by treating the surface of the hydrophilic support with an aqueous solution of at least one oxygen acid or oxygen acid salt to thereby provide a new hydrophilic layer.

A further object of the present invention is to provide a light-sensitive lithographic printing plate element which is capable of being used to produce a lithographic printing plate on which no scumming of the background upon printing occurs.

A further object of the present invention is to provide a light-sensitive lithographic printing plate element in which a difference in adhesion to the hydrophilic support between the exposed areas and the unexposed areas of the light-sensitive composition layer is used to form an image.

A further object of the present invention is to provide a light-sensitive lithographic printing plate element in which the light-sensitive composition layer provided on the hydrophilic support is stable with the passage of time and in which the stability is improved irrespective of the kind of components in the light-sensitive composition.

The invention, therefore, provides a light-sensitive lithographic printing plate element comprising a hydrophilic support having thereon, in succession, a light-sensitive composition layer and a transparent cover film in which an image for lithographic printing is formed by imagewise exposing the element through the cover film and peeling apart to remove, together with the cover film, the areas having a stronger adhesion to the cover film in the light-sensitive composition layer by utilizing the difference in adhesion to the support and to the cover film between the exposed areas and the unexposed areas of the light-sensitive composition layer, whereby the areas of the light-sensitive composition layer having a stronger adhesion to the support remain on the support, wherein in the light-sensitive lithographic printing plate element a layer of at least an oxygen acid or a salt thereof is provided on the surface of the hydrophilic support by treating the surface of the support adjacent the light-sensitive composition layer with an aqueous solution containing at least one water soluble oxygen acid or water soluble oxygen acid salt selected from the group consisting of boric acid, boric acid salts, molybdic acids, molybdic acid salts, phosphoric acids, phosphoric acid salts, vanadic acids, vanadic acid salts, tungstic acids, tungstic acid salts, chromic acid, chromic acid salts, silicic acid and silicic acid salts.

DETAILED DESCRIPTION OF THE INVENTION

Preferred examples of the hydrophilic supports which can be employed in the present invention include those which have at least a hydrophilic surface, wherein the full support may be hydrophilic or only the surface thereof may be hydrophilic. Such hydrophilic supports which can be used in this invention include a pure aluminum plate, an aluminum alloy plate containing any one of copper, zinc, iron, magnesium, and the like, a zinc plate, a chromium plate, a plate in which any one of chromium, aluminum and zinc is laminated onto copper or iron, a three-layer plate in which copper is laminated onto zinc or iron and chromium or aluminum is further laminated thereon, a plate in which any one of aluminum, chromium and zinc is laminated onto a synthetic resin such as polyethylene terephthalate, polymethylmethacrylate or the like. Most preferred hydrophilic supports used in accordance with the present invention have at least a hydrophilic surface (layer) which exhibits a contact angle of 0° to about 120°, even more preferably 0° to 50°, with water. These supports are preferably degreased and grained or subjected to a similar processing so as to provide a fine irregular surface thereon, as disclosed in, for example, Japanese Patent Publication 28,123/1973. Preferably, the degree of fine irregularity is not less than about 0.01 μm, even more preferably 0.1 μm to 3 μm, expressed as a center line average height $H_{CLA}$ (JIS). It is also preferred for the surface of the support to be subjected to a sand graining treatment or other alternative treatments to create an uneven microstructure on the surface of the support. The present invention will be explained in greater detail hereinafter using an aluminum plate as a representative example of such a support. However, the present invention can be practiced even in the case of using hydrophilic supports other than an aluminum plate by appropriate modifications which can be easily made by one skilled in the art based on the disclosure to follow on an aluminum plate.

With regard to the aluminum support, its surface is grained and/or an anodic oxide layer specific to an aluminum support is provided on the aluminum surface, preferably the aluminum surface is grained and then an anodic oxide layer is provided on the aluminum surface. To increase adhesion between the aluminum plate and the image areas, an aluminum plate having an anodic oxide layer on the grained surface thereof, particularly containing phosphoric acid radicals in the anodic oxide layer, is preferably used. Although such is not to be construed as being limiting, generally preferred results are obtained when the anodic oxide layer has a thickness of from about 50 nm to about 10 μm, even more preferably 0.3 μm to 4 μm.

The aluminum or aluminum alloys utilized are not particularly limited, and a variety of alloys can be used including those containing silicon, copper, manganese, magnesium, chromium, zinc, lead, bismuth, nickel, etc. Some representative examples of typical alloy compositions are shown in the following table. In the table, the values given are in percent by weight, with the remainder being the percent by weight aluminum.

| Compositions of Typical Aluminum Alloys | | | | | | | |
|---|---|---|---|---|---|---|---|
| Alloy No. | Si | Cu | Mn | Mg | Cr | Zn | Al |
| 2S | 0.4 | — | — | 0.6 | — | — | 99.0 |
| 3S | — | — | 1.2 | — | — | — | 98.8 |
| 24S | — | 4.5 | 0.6 | 1.5 | — | — | 93.4 |
| 52S | — | — | — | 2.5 | 0.25 | — | 97.25 |
| 61S | 0.6 | 0.25 | — | 1.0 | 0.25 | — | 97.9 |
| 75S | — | 1.60 | — | 2.50 | 0.30 | 5.60 | 95.0 |

These compositions generally include, in addition, small amounts of Fe and Ti and negligible amounts of impurities not shown in the table.

The anodic oxide layer can be produced by conventional methods. For instance, a direct electric current can be passed through an electrolyte of an aqueous solution of an inorganic acid such as phosphoric acid, sulfuric acid, chromic acid, or the like, or an organic acid such as oxalic acid, sulfamic acid or the like, with an aluminum plate as an anode to form an anodic oxide layer on the aluminum plate. Incorporation of phosphoric acid radicals into the anodic oxide layer can be, as is described in Japanese Pat. Publication No. 26,521/1971, accomplished by a method comprising effecting anodic oxidation in a phosphoric acid bath, or by treating the anodic oxide layer in a solution containing phosphoric acid. In the event that the anodic oxidation is carried out using an electrolyte of an aqueous solution of phosphoric acid, the post treatment with the oxygen acid or the oxygen acid salt in accordance with the present invention may be carried out using either a phosphoric acid or phosphoric acid salt aqueous solution again or other oxygen acid or oxygen acid salt aqueous solutions.

Typical anodizing conditions, of course, depend on the composition of the electrolytic solution used and thus cannot be defined unequivocally. In general, suitable anodizing conditions are as follows: acid concentration: about 1 to 80% by weight; temperature of solution: about 5° to 70° C.; current density: about 0.5 to 60 amp/dm$^2$; voltage: about 1 to 100 volts; period of electrolysis: about 30 sec to 50 min. Suitable anodizing procedures are disclosed in, for example, U.S. Pat. Nos. 3,808,000, 3,181,461, 3,280,734, and 3,511,661. The following table summarizes suitable anodic oxidation processing conditions in greater detail.

| Electrolytic Solution | Solution Concentration (wt %) | Solution Temperature (°C.) | Current Density (A/dm$^2$) | Voltage (V) | Period (min) |
|---|---|---|---|---|---|
| Sulfuric Acid | 1-70 | 5-65 | 0.5-30 | 1-50 | 1-30 |
| Oxalic Acid | 1-20 | 20-60 | 0.5-20 | 10-70 | 5-40 |
| Phosphoric Acid | 2-60 | 20-60 | 0.5-20 | 10-60 | 1-30 |
| Chromic Acid | 2-30 | 30-60 | 0.5-10 | 10-60 | 1-50 |

Typical examples of water soluble oxygen acids (oxoacids) and water soluble oxygen acid salts (oxoacid salts) which can be used in accordance with the present invention including the following examples.

BORIC ACID AND BORIC ACID SALTS

Boric acid ($H_3BO_3$), lithium metborate ($LiBO_2.2H_2O$), lithium tetraborate ($Li_2B_4O_7.5H_2O$), sodium metaborate ($NaBO_2$), sodium tetraborate ($Na_2B_4O_7.10H_2O$), sodium decaborate ($Na_2B_{10}O_{16}.10H_2O$), sodium perborate ($NaBO_2.H_2O_2.3H_2O$), sodium borate-hydrogen peroxide addition product ($Na_2B_4O_7.H_2O_2.9H_2O$), sodium borate formate ($NaH_2BO_3.2HCOOH.2H_2$), potassium metaborate ($KBO_2$), potassium tetraborate ($K_2B_4O_7.5H_2O$), ammonium tetraborate ($(NH_4)_2B_4O_7.4H_2O$), ammonium biborate, and the like.

MOLYBDIC ACIDS AND MOLYBDIC ACID SALTS

Orthomolybdic acid ($H_2MoO_4.H_2O$), a molybdic acid salt represented by the formula $xM_2O.yMoO_3.nH_2O$ (wherein M represents Li, Na, K or $NH_4$, x is an integer of 1 to 5, y is an integer of 1 to 12 and n is 0 or a positive integer), for example, lithium molybdate ($Li_2MoO_4$), sodium molybdate ($Na_2MoO_4$), potassium molybdate ($K_2MoO_4.5H_2O$), ammonium heptamolybdate ($(NH_4)_6Mo_7O_{24}.4H_2O$), etc., sodium phosphomolybdate ($Na_3PO_4.12MoO_3$), ammonium phosphomolybdate ($(NH_4)_3PO_4.12MoO_3.3H_2O$), and the like.

PHOSPHORIC ACIDS AND PHOSPHORIC ACID SALTS

Orthophosphoric acid ($H_3PO_4$); metaphosphoric acid ($HPO_3$); an orthophosphoric acid salt represented by the formula $M_3PO_4$ (wherein M is Li, Na, K or $NH_4$), for example, lithium orthophosphate, lithium dihydrogen orthophosphate, sodium dihydrogen orthophosphate, disodium hydrogen orthophosphate, sodium orthophosphate, etc.; a pyrophosphoric acid salt represented by the formula $M_4P_2O_7$ (wherein M is the same as defined above), for example, sodium pyrophosphate, etc.; a polyphosphoric acid salt represented by the formula $(MPO_3)_m$ (wherein M is the same as defined above and m is an integer of 3 or more), for example, sodium hexametaphosphate; and the like.

VANADIC ACIDS AND VANADIC ACID SALTS

Metavanadic acid, lithium orthovanadate ($Li_3VO_4$), sodium orthovanadate ($Na_3VO_4$), sodium hydrogen orthovanadate, lithium metavanadate ($LiVO_3.2H_2O$), sodium metavanadate ($NaVO_3.4H_2O$), potassium metavanadate ($KVO_3$), ammonium metavanadate ($NH_4VO_3$ or $(NH_4)_4V_4O_{12}$), sodium pyrovanadate ($Na_2V_2O_7.18H_2O$), and the like.

TUNGSTIC ACIDS AND TUNGSTIC ACID SALTS

Orthotungstic acid ($H_2WO_4$), metatungstic acid ($H_2W_4O_{13}.pH_2O$, where p is 17, 22 or 26), an orthotungstic acid salt represented by the formula $M_2O.WO_3qH_2O$ (wherein M is Li, Na, K or $NH_4$ and q is 0 or a positive integer), for example, lithium tungstate ($Li_2WO_4$), sodium tungstate ($Na_2WO_4.2H_2O$), potassium tungstate ($K_2WO_4.2H_2O$), etc., a metatungstic acid salt represented by the formula $M_2O.4WO_3.rH_2O$ (wherein M is the same as defined above and r is 0 or a positive integer), e.g., sodium metatungstate ($Na_2W_4O_{13}.13H_2O$), etc., a paratungstic acid salt represented by the formula $5M_2O.12WO_3$ (wherein M is the same as defined above), e.g., sodium paratungstate ($Na_{10}W_{12}O_{41}$), etc., ammonium pentatungstate ($(NH_4)_4W_5O_{17}.5H_2O$), ammonium heptatungstate ($(NH_4)_6W_7O_{24}.6H_2O$), sodium phosphotungstate ($Na_3PO_4.12WO_3.18H_2O$), barium borotungstate ($Ba_2[B(W_2O_7)_6]_2$), and the like.

CHROMIC ACID AND CHROMIC ACID SALTS

Lithium chromate ($Li_2CrO_4.2H_2O$), sodium chromate ($Na_2CrO_4.10H_2O$), potassium chromate ($K_2CrO_4$), ammonium chromate ($(NH_4)_2CrO_4$), calcium chromate ($CaCrO_4.2H_2O$), strontium chromate ($SrCrO_4$), and the like.

SILICIC ACIDS AND SILICIC ACID SALTS

Orthosilicic acid, a silicic acid salt represented by the formula $L_2O.zSiO_2$ (wherein L is Li, Na, K, $NH_4$, $N(CH_2OH)$ or $N(C_2H_4OH)_4$, and z is positive and ranges from 0.2 to 9.0), e.g., lithium silicate, sodium silicate, potassium silicate, ammonium silicate, tetramethanol ammonium silicate, tetraethanol ammonium silicate, and the like.

The concentration of the above-described water soluble oxygen acid(s) or the salt(s) thereof used in the present invention must be above about 0.01 wt%. When the concentration is smaller than about 0.01 wt%, substantially no treatment effect is obtained. Substantially no upper limit of the concentration exists and such is limited only by the saturation concentration of the respective oxygen acids or salts thereof in water.

However, if an aqueous solution containing these water soluble oxygen acids or salts thereof in a concentration exceeding about 10 wt% is used for the treatment, no particular improvement in the treatment effect is obtained. Thus, a concentration ranging from 0.01 to 10 wt% is preferred. In addition, where relatively lesser soluble oxygen acids or salts thereof are employed, various difficulties when they are employed in an amount exceeding their solubility occur such as crystal deposition even if it is less than about 10 wt%, which is not preferred, either. Where an aqueous solution of phosphoric acid ($H_3PO_4$) is employed, the concentration of the phosphoric acid is most preferably from about 0.01 to about 2.5% by weight.

Where two or more water soluble oxygen acids or salts thereof are employed in combination, no problems occur in the combined use of the acids or salts belonging to the same group if the anion portion of the acid or salt is common, since there is little danger of forming precipitates. However, precipitates are sometimes formed when acids or salts thereof of different groups are employed in combination so that care should be taken with the combined use of these materials. For example, formation of precipitates is a serious problem when molybdates and tungstates, tungstates and borates, chromates and molybdates, or chromates and tungstates are used together. However, no substantial problems with the other combinations exist.

A metal having thereon hydrophilic surfaces which is to be treated is simply immersed in an aqueous solution of an oxygen acid or an oxygen acid salt as described above and at a concentration of about 0.01 to about 10% by weight. The treatment with the aqueous solution can be carried out using various methods such as an immersion method, a spray method, or the like. The oxygen acid or oxygen acid salt aqueous solution may, of course, also be coated on the surfaces of the support by means of known methods, such as dip coating, air knife coating, curtain coating, hopper type extrusion coating, spray coating, or the like.

The water soluble oxygen acids or salts thereof which can be used in accordance with the present invention can be employed as a treating solution for treating the hydrophilic support, after dissolving the acid or salt in water, at a treating temperature ranging from about 20° C. to about one degree less than the boiling temperature of the solution for a treating period of time ranging from about 5 seconds to about 5 minutes. The preferred ranges for the treating temperature and the treating period of time are about 30° C. to about 85° C. and about 20 seconds to about 3 minutes, respectively, and the most preferred ranges for the treating temperature and treating period of time are about 35° C. to about 75° C. and about 30 seconds to about 90 seconds, respectively.

Another embodiment for treating the surface of the hydrophilic support with the above-described water soluble oxygen acids or salt thereof comprises initially treating the surface with an aqueous solution of at least one oxygen acid or a salt thereof as above indicated, then washing the surface with water (or without water washing) and then treating the surface with an aqueous solution of at least one oxygen acid or a salt thereof as indicated above, different from that used in the first treatment. An example of this embodiment in which a remarkable effect is obtained comprises initially treating the surface with an aqueous solution of at least one of a phosphoric acid or a phosphate, then washing the surface with water (or without water washing) and then treating the surface with an aqueous solution of at least one of a silicic acid or a silicate. Of these embodiments, an embodiment comprising initially treating the hydrophilic surface with an aqueous solution of phosphoric acid, with or without a subsequent washing treatment with water, and then treating the surface with an aqueous solution of a silicic acid or a silicic acid salt gives rise to excellent results in the printing step which is carried out in the later stage because a particularly suitable adhesive strength between the support and the light-sensitive composition layer is obtained and peel-apart development after the imagewise exposure can be suitably carried out.

The present invention is particularly effective when it is applied to an aluminum support which has been subjected to an anodic oxidation treatment. The present invention can be carried out by using aluminum anodically oxidized in a sulfuric acid bath which is commercially available. The aluminum plate may also be subjected to a surface treatment to roughen the surface mechanically or electrochemically prior to the anodic oxidation.

The starting material may also be untreated aluminum, which can be degreased, washed, the surface roughened and anodically oxidized in actual commercial products. For example, the surface roughening treatment can be carried out by electrolysis in an aqueous solution at a temperature ranging from about 20° to about 30° C. containing about 0.5 wt% hydrochloric acid using a voltage of about 10 to about 15 V using an alternating electric current of from about 3 to about 5 A/dm$^2$. The anodic oxidation can be specifically practiced in an aqueous solution at a temperature ranging from about 20° to about 30° C. containing about 10 to about 25 wt% sulfuric acid at a voltage of from about 10 to about 20 V using a direct electric current of from about 3 to about 5 A/dm$^2$.

The provision of a layer of the acids or salts thereof on the aluminum base plate having a porous aluminum oxide layer by treatment with an aqueous solution of the oxygen acids or salts thereof described above can be carried out by immersing the aluminum plate in a solution at the above-described temperature. The concentration of the solution is sufficiently dilute that the acids or salts thereof can freely permeate into the pores. After drying, the treated surface portion of an aluminum support which is rendered hydrophilic with the above-described oxygen acids or salts thereof, or by forming an absorbed layer of hydrophilic compounds derived from the above-described oxygen acids or salts thereof and aluminum by chemical reaction in the surface portion of the aluminum support. The formation of such a hydrophilic compound layer is assumed to occur since the surface remaining after the removal of the subsequently formed light-sensitive resin layer by peeling-apart possesses a remarkable water receptive property as compared to an untreated surface. In addition, X-ray observation or analytical chemical examination of the surface thereof confirms that the elements composing the anion portions of the water soluble oxygen acids or salts thereof are present in a high concentration.

The light-sensitive lithographic printing plate element of the present invention can be obtained by providing by coating a layer of a light-sensitive composition, which is hardenable by photopolymerization, on the aluminum support having thereon the layer treated with the aqueous solution of the above-described oxygen acids or salts thereof, and then further providing by lamination of the light-sensitive composition layer a thin cover film for peeling apart. As another embodiment, the light-sensitive lithographic printing plate element of the present invention can also be obtained by laminating, under pressure or with heating, if necessary, a thin cover film having thereon a light-sensitive composition layer onto the aluminum support having thereon a layer treated with the aqueous solution of the above-described oxygen acids or salts thereof, so as to position the light-sensitive composition layer adjacent the layer treated with the aqueous solution of the above-described oxygen acids or salts thereof.

A suitable light-sensitive composition which can be employed in accordance with the present invention is a composition comprising an organic high molecular weight material as a binder, a monomer having at least one addition polymerizable ethylenically unsaturated bond and a photopolymerization (or photocross-linking) initiator. The light-sensitive compositions described in Japanese Patent Application (OPI) 123,021/1974, corresponding to U.S. patent application Ser. No. 455,087, filed Mar. 27, 1974 now abandoned, Japanese patent application (OPI) No. 46,315/1975 and Japanese Patent application (OPI) No. 39,025/1976, corresponding to U.S. patent application Ser. No. 617,603, filed Sept. 29, 1975 now U.S. Pat. No. 617,603, can also be employed preferably in the present invention.

Organic high molecular weight materials which can be employed as a binder in the light-sensitive composition used in the element of the present invention can be selected from a wide variety of synthetic, semi-synthetic and natural high molecular weight materials, which should have the following properties. That is, the high molecular weight material should be compatible with a monomer having at least one addition polymerizable ethylenically unsaturated bond and with the photopolymerization initiator to an extent that no phase separation is caused during the preparation steps of mixing of the coating solution, coating and drying. The composition of the above-described monomer and the organic high molecular weight material in combination should have an appropriate adhesion strength to the support. The adhesion strength should be altered when the above-described monomer is converted to a polymer by exposure to light and thus an image is formed by peeling-apart the cover film. The organic high molecular weight materials should possess suitable properties depending upon the intended use of the element in accordance with the present invention, for example, the strength, ductility, abrasion resistance, resistance to chemicals (e.g., be resistant to oils and fats, be resistant to organic solvents, be water-proof, etc.) of the polymer should be appropriate. In order for the photopolymerizable composition light-sensitive layer to be easily separated at the boundary between the image areas and the non-image areas upon peeling-apart development, the molecular weight, intermolecular force, hardness, softening point, crystallizability, elongation at break, etc., of the polymer should be appropriate. Specific examples of organic high molecular weight materials include homopolymers or copolymers, e.g., a chlorinated polyolefin such as chlorinated polyethylene, chlorinated polypropylene, etc.; a polyacrylic acid; a polymethacrylic acid; a polyacrylic acid alkyl ester (with suitable examples of alkyl groups including a methyl group, an ethyl group, a butyl group, etc.); a copolymer of an alkyl acrylate (with suitable examples of alkyl groups being the same as described above) and at least one monomer such as acrylonitrile, vinyl chloride, vinylidene chloride, styrene, butadiene, etc.; polyvinyl chloride; a copolymer of vinyl chloride and acrylonitrile; polyvinylidene chloride; a copolymer of vinylidene chloride and acrylonitrile; polyvinyl acetate; a copolymer of vinyl acetate and vinyl chloride; polyvinyl alcohol; polyvinyl acetate; polyvinyl pyrrolidone; polyacrylonitrile; a copolymer of acrylonitrile and styrene; a copolymer of acrylonitrile, butadiene and styrene; a polyvinyl alkyl ether (with suitable examples of alkyl groups including a methyl group, an ethyl group, an isopropyl group, a butyl group, etc.); polymethyl vinyl ketone; polyethyl vinyl ketone; polyethylene; polypropylene; polybutene; polystyrene; poly-α-methyl styrene; a polyamide (e.g., nylon-6-, nylon-6,6 nylon-6,10, etc.); poly-1,3-butadiene; polyisoprene; a polyurethane; polyethylene terephthalate; polyethylene isophthalate; a chlorinated rubber; polychloroprene; ethyl cellulose; acetyl cellulose; polyvinyl butyral; polyvinyl formal; a styrene-butadiene rubber; chlorosulfonated polyethylene; and the like. In the case of a copolymer, the monomer ratio in the copolymer can vary widely, but, in general, the content of the minor component preferably ranges from 10 mol% to 50 mol% based on the total monomers. In addition, thermoplastic high molecular weight materials other than the materials described above can also be employed in the present invention as long as the above-described characteristics of the high molecular weight material are met.

Of these polymers, preferred examples of polymers which can be desirably used in accordance with the present invention are a chlorinated polyolefin represented by chlorinated polyethylene and chlorinated polypropylene, polymethyl methacrylate, polyvinyl chloride, a vinyl chloridevinylidene chloride copolymer (molar content of vinyl chloride: about 20 to about 80%), a vinylidene chloride-acrylonitrile copolymer (molar content of acrylonitrile: about 10 to about 30%), a vinyl chloride-acrylonitrile copolymer (molar content of acrylonitrile: about 10 to about 30%), polystyrene, polyvinyl butyral, polyvinyl acetate, polyvinyl formal, ethyl cellulose, acetyl cellulose, a vinyl chloride-vinyl acetate copolymer, polychloroprene, polyisoprene, a chlorinated rubber and chlorosulfonated polyethylene, etc. Chlorinated polyolefins represented by chlorinated polyethylene and chlorinated polypropylene and polyvinyl butyral are particularly preferred.

A chlorinated polyolefin is a high molecular weight material obtained by chlorinating a polyolefin, which is described in detail in Japanese Patent Publication 11,190/1971, etc. Of the chlorinated polyolefins which can be used in the present invention, particularly preferred are chlorinated polyethylene and chlorinated polypropylene. In addition to the properties conventional synthetic resins have, chlorinated polyethylene has characteristic properties of being weatherproof heat resistant, resistant to chemicals, resistant to ozone, etc. The properties of chlorinated polypropylene are similar to those of chlorinated polyethylene. The chlorinated polyolefins which can be suitably used in accordance with the present invention have a polymerization degree of about 300 to 20,000, preferably 1,000 to 8,000. In addition, a suitable chlorine content ranges from about 20 to about 80 wt%, preferably 50 to 75 wt%. The higher the chlorine content of the chlorinated polyolefin, the greater the specific gravity thereof and the higher the solubility in a solvent such as toluene, 1,2-dichloroethane, etc. Further, depending upon the chlorine content, the softening point, elongation at break, tension, crystallizability, etc., will vary. In addition, compatibility with many other resins, plasticizers, monomers, polymerization initiators, and the like also vary.

A polyvinyl butyral having a polymerization degree of about 200 to about 1,500 and a butylation degree of about 55 to about 75 mol% is also preferably used. A copolymer containing mainly vinyl butyral units and containing vinyl acetate and vinyl alcohol units in a small amount (typically in an amount of less than about 10 mol%) can also be used.

The molecular weight of the organic high molecular weight materials described above which can be employed as binders can vary over a wide range depending upon the kind of polymer, but, in general, polymers having a molecular weight of about 5,000 to about 2,000,000, more preferably 10,000 to 1,000,000, can be suitably employed.

These polymers can, of course, be employed individually, but can also be used as a combination of two or more kinds of polymers which have good compatibility so as not to cause phase separation of the pre-formed mixture during preparation of the coating solution, coating and drying, in an appropriate ratio.

Particularly important characteristics of the photopolymerizable composition used in accordance with the present invention are the layer strength of the printed image formed by peel-apart development and adhesion strength to the support. In general, the best image can be obtained when chlorinated polyethylene or chlorinated polypropylene is employed. But, it is sometimes useful to use chlorinated polyethylene or chlorinated polypropylene as a main component in combination with various polymers as described above in a small amount, e.g., about 20% by weight or less, preferably 10% by weight or less, based on the weight of the chlorinated polyolefin. In this case, the mixing ratio can be freely chosen depending upon the desired image forming capability, layer strength, etc. By doing such, more preferred images having a stronger strength which cannot be obtained by the individual use of a binder can be obtained without destroying good image forming capability as obtained when chlorinated polyethylene alone or chlorinated polypropylene alone is used.

Any monomers having at least one addition polymerizable unsaturated bond can be employed as the monomer used in accordance with the present invention. Examples of such addition polymerizable unsaturated compounds include, for example, acrylic acid esters, acrylamides, methacrylic acid esters, methacrylamides, allyl compounds, vinyl ethers, vinyl esters, N-vinyl compounds, styrenes, crotonic acid esters, and the like. Specific examples of compounds having one addition polymerizable unsaturated bond include, acrylic acid esters, e.g., acrylic acid, alkyl acrylates (for example, propyl acrylate, butyl acrylate, amyl acrylate, ethylhexyl acrylate, octyl acrylate, t-octyl acrylate, chloroethyl acrylate, hydroxyethyl acrylate, hydroxypropyl acrylate, 2,2-dimethylhydroxypropyl acrylate, 5-hydroxypentyl acrylate, diethylene glycol monoacrylate, trimethylol propane monoacrylate, pentaerythritol monoacrylate, glycidyl acrylate, benzyl acrylate, methoxybenzyl acrylate, furfuryl acrylate, tetrahydrofurfuryl acrylate, etc.), aryl acrylates (e.g., phenyl acrylate, etc.); methacrylic acid esters, for example, methacrylic acid, alkyl methacrylates (e.g., methyl methacrylate, ethyl methacrylate, propyl methacrylate, isopropyl methacrylate, amyl methacrylate, hexyl methacrylate, cyclohexyl methacrylate, benzyl methacrylate, chlorobenzyl methacrylate, octyl methacrylate, N-ethyl-N-phenylaminoethyl methacrylate, ethyleneglycol monomethacrylate, 2-hydroxyethyl methacrylate, 3-hydroxypropyl methacrylate, 2-hydroxypropyl methacrylate, 4-hydroxybutyl methacrylate, 5-hydroxypentyl methacrylate, 2,2-dimethyl-3-hydroxypropyl methacrylate, diethyleneglycol monomethacrylate, trimethylol propane monomethacrylate, pentaerythritol monomethacrylate, glycidyl methacrylate, furfuryl methacrylate, tetrahydrofurfuryl methacrylate, etc.; aryl methacrylates (e.g., phenyl methacrylate, cresyl methacrylate, naphthyl methacrylate, etc.); acrylamides, for example, acrylamide, N-alkyl acrylamides (with suitable examples of alkyl groups being a methyl group, an ethyl group, a propyl group, a butyl group, a t-butyl group, a heptyl group, an octyl group, a cyclohexyl group, a benzyl group, a hydroxymethyl group, a hydroxyethyl group, a benzyl group, etc.), N-arylacrylamides (with specific examples of aryl groups being a phenyl group, a tolyl group, a nitrophenyl group, a naphthyl group, a hydroxyphenyl group, etc.), N,N-dialkylacrylamides (with specific examples of alkyl groups including a methyl group, an ethyl group, a butyl group, an isobutyl group, an ethylhexyl group, a cyclohexyl group, etc.), N,N-diarylacrylamides (with specific examples of aryl groups including a phenyl group, etc.), N-methyl-N-phenylacrylamide, N-hydroxyethyl-N-methacrylamide, N-2-acetamidoethyl-N-acetylacrylamide, etc.; methacrylamides, for example, methacrylamide, N-alkylmethacrylamides (with specific examples of alkyl groups including a methyl group, an ethyl group, a t-butyl group, an ethylhexyl group, a hydroxyethyl group, a cyclohexyl group, etc.), N-arylmethacrylamides (with specific examples of aryl groups including a phenyl group, etc.), N,N-dialkylmethacrylamides (with specific examples of alkyl groups being an ethyl group, a propyl group, a butyl group, etc.), N,N-diarylmethacrylamides (with specific examples of aryl groups including a phenyl group, etc.), N-hydroxyethyl-N-methyl methacrylamide, N-methyl-N-phenylmethacrylamide, N-ethyl-N-phenylmethacrylamide, etc.; allyl compounds, for example, allyl esters (for example allyl acetate, allyl caproate, allyl caprylate, allyl laurate, allyl palmitate, allyl stearate, allyl benzoate, allyl acetoacetate, allyl lactate, etc.), allyloxy ethanol, etc.; vinyl ethers, for example, alkyl vinyl ethers (for example, hexyl vinyl ether, octyl vinyl ether, decyl vinyl ether, ethylhexyl vinyl ether, methoxyethyl vinyl ether, ethoxyethyl vinyl ether, chloroethyl vinyl ether, 1-methyl-2,2-dimethylpropyl vinyl ether, 2-ethyl butyl ether, hydroxyethyl vinyl ether, diethyleneglycol vinyl ether, dimethylaminoethyl vinyl ether, diethylaminoethyl vinyl ether, butylaminoethyl vinyl ether, benzyl vinyl ether, tetrahydrofurfuryl vinyl ether, etc.), vinyl aryl ethers (for example, vinyl phenyl ether, vinyl tolyl ether, vinyl chlorophenyl ether, vinyl 2,4-dichlorophenyl ether, vinyl naphthyl ether, vinyl anthranyl ether, etc.); vinyl esters, for example, vinyl butyrate, vinyl isobutyrate, vinyl trimethyl acetate, vinyl diethyl acetate, vinyl valerate, vinyl caproate, vinyl chloroacetate, vinyl dichloroacetate, vinyl methoxyacetate, vinyl butoxyacetate, vinyl phenylacetate, vinyl acetoacetate, vinyl lactate, vinyl-$\beta$-phenyl butyrate, vinyl cyclohexylcarboxylate, vinyl benzoate, vinyl salicylate, vinyl tetrachlorobenzoate, vinyl naphthoate, etc.; N-vinyl compounds, for example, N-vinyloxazolidone, N-vinylimidazole, N-vinylpyrrolidone, N-vinylcarbazole, N-vinylethylacetamide, etc.; styrenes, for example, styrene, alkyl styrenes (e.g., methylstyrene, dimethylstyrene, trimethylstyrene, ethylstyrene, diethylstyrene, isopropylstyrene, butylstyrene, hexylstyrene, cyclohexylstyrene, decylstyrene, benzylstyrene, chloromethylstyrene, trifluoromethylstyrene, ethoxymethylstyrene, acetoxymethylstyrene, etc.), alkoxystyrenes (e.g., methoxystyrene, 4-methoxy-3-methylstyrene, dimethoxystyrene, etc.), halostyrenes (e.g., chlorostyrene, dichlorostyrene, trichlorostyrene, tetrachlorostyrene, pentachlorostyrene, bromostyrene, dibromostyrene, iodostyrene, fluorostyrene, trifluorostyrene, 2-bromo-4-trifluoromethylstyrene, 4-fluoro-3-trifluoromethylstyrene, etc.), carboxy styrenes (e.g., vinylbenzoic acid, vinyl benzoic acid methyl ester, etc.); crotonic acid esters, for example, alkyl crotonates (e.g., methyl crotonate, butyl crotonate, hexyl crotonate, glycerin monocrotonate, etc.), and the like.

Specific examples of compounds having at least two addition polymerizable unsaturated bonds are shown below, which are more preferably used than the compounds having one addition polymerizable unsaturated bond described above. Firstly, typical examples of acrylic acid esters and methacrylic acid esters include polyacrylates and polymethacrylates (the term "poly" as used herein refers to di- or higher acrylates of a polyhydric alcohol). Specific examples of the above-described polyhydric alcohols are ethylene glycol, and polyethylene glycols (such as diethylene glycol, triethylene glycol, tetraethylene glycol, octaethylene glycol, nonaethylene glycol, tetradecaethylene glycol, etc.), propylene oxide and polypropylene oxides (such as dipropylene oxide, tripropylene oxide, tetrapropylene oxide, etc.), polybutylene oxide, polycyclohexane oxide, polyethylene oxidepropylene oxide, polystyrene oxide, polyoxetane, polytetrahydrofuran, cyclohexanediol, xylylenediol, bis($\beta$-hydroxyethoxy)benzene, glycerin, diglycerin, tetramethyleneglycol, neopentyl glycol, trimethylolethane, pentaerythritol, dipentaerythritol, tripentaerythritol, tetrapentaerythritol, sorbitan, sorbitol, d-mannitol, butanediol, 1,10-decanediol, butanetriol, 2-butene-1,4-diol, 2-n-butyl-2-ethylpropanediol, 2-butyne-1,4-diol, 3-chloro-1,2-propanediol, 1,4-cyclohexanedimethanol, 3-cyclohexene-1,1-dimethanol, decalindiol, 2,3-dibromo-2-butene-1,4-diol, 2,2-diethyl-1,3-propanediol, 1,5-dihydroxy-1,2,3,4-tetrahydronaphthalene, 2,5-dimethyl-2,5-hexanediol, 2,2-dimethyl-1,3-propanediol, 2,2-diphenyl-1,3-propanediol, dodecanediol, mesoerythritol, 2-ethyl-1,3-hexanediol, 2-ethyl-2-(hydroxymethyl)-1,3-propanediol, 2-ethyl-2-methyl-1,3-propanediol, heptanediol, hexanediol, 3-hexene-2,5-diol, hydroxybenzyl alcohol, hydroxyethylresorcinol, 2-methyl-1,4-butanediol, 2-methyl-2,4-pentanediol, nonanediol, octanediol, 1,5-pentanediol, 1-phenyl-1,2-ethanediol, 1,3-propanediol, 2,2,4,4-tetramethyl-1,3-cyclobutanediol, 2,3,5,6-tetramethyl-p-xylene-α,α'-diol, 1,1,4,4-tetraphenyl-1,4-butanediol, 1,1,4,4-tetraphenyl-2-butyne-1,4-diol, 1,2,6-trihydroxyhexane, 1,1'-bis-2-naphthol, dihydroxynaphthalene, 1,1'-methylenedi-2-naphthol, 1,2,4-benzenetriol, biphenol, 2,2'-bis(4-hydroxyphenyl)butane, 1,1-bis(4-hydroxyphenyl)cyclohexane, bis(hydroxyphenyl)methane, catechol, 4-chlororesorcinol, 3,4-dihydroxyhydrocinnamic acid, hydroquinone, hydroxybenzyl alcohol, methylhydroquinone, methyl-2,4,6-trihydroxybenzoate, phloroglucinol, pyrogallol, resorcinol, glucose, α-(1-aminoethyl)-p-hydroxybenzyl alcohol, 2-amino-2-ethyl-1,3-propanediol, 2-amino-2-methyl-1,3-propanediol, 3-amino-1,2-propanediol, N-(3-aminopropyl)diethanolamine, N,N'-bis(2-hydroxyethyl)piperazine, 2,2-bis(hydroxydimethyl)-2,2',2''-nitrilotriethanol, 2,2-bis(hydroxymethyl)propionic acid, 1,3-bis(hydroxymethyl)urea, 1,2-bis(4-pyridyl)-1,2-ethanediol, N-n-butyldiethanolamine, diethanolamine, N-ethyldiethanolamine, 3-mercapto-1,2-propanediol, 3-piperidino-1,2-propanediol, 2-(2-pyridyl)-1,3-propanediol, triethanolamine, α-(1-aminoethyl)-p-hydroxybenzyl alcohol, 3-amino-4-hydroxyphenylsulfone, etc. Of these acrylic acid esters and methacrylic acid esters, preferred are ethylene glycol diacrylate, diethylene glycol dimethacrylate, polyethylene glycol diacrylate, pentaerythritol triacrylate, pentaerythritol dimethacrylate, dipentaerythritol pentacrylate, glycerin triacrylate,diglycerin dimethacrylate, 1,3-propanediol diacrylate, 1,2,4-butanetriol trimethacrylate, 1,4-cyclohexanediol diacrylate, 1,5-pentanediol diacrylate, neopentylglycol diacrylate, sorbitol diacrylate, sorbitol triacrylate, sorbitol tetracrylate, sorbitol tetramethacrylate, sorbitol hexaacrylate, ethylene oxide adduct of trimethylol propane triacrylate, etc.

Next, suitable examples of addition polymerizable compounds having at least two addition polymerizable bonds are acrylamides and methacrylamides. Specific examples of these compounds include polyacrylamides and polymethacrylamides such as methylenebisacrylamide, methylenebismethacrylamide, ethylenebisacrylamide, ethylenebismethacrylamide, trimethylenebisacrylamide, trimethylenebismethacrylamide, tetramethylenebisacrylamide, tetramethylenebismethacrylamide, pentamethylenebisacrylamide, pentamethylenebismethacrylamide, hexamethylenebisacrylamide, hexamethylenebismethacrylamide, heptamethylenebisacrylamide, heptamethylenebismethacrylamide,octamethylenebisacrylamide, octamethylenebismethacrylamide, phenylenebisacrylamide, phenylenebismethacrylamide, xylylenebisacrylamide, xylxlenebismethacrylamide, bis(acrylamido)benzoic acid, bis(methacrylamido)benzoic acid, bis(acrylamido)toluene, bis(methacrylamido)toluene, bis(acrylamido)anthraquinone, bis(methacrylamido)anthraquinone, bis(acrylamido)fluorene, bis(methacrylamido)fluorene, 4,β-bisacrylamido-1-ethylbenzene, 4,β-bismethacrylamido-1-ethylbenzene, 1,2,11,12-tetrakis(acrylamido)dodecane, 1,2,11,12-tetrakis(methacrylamido)dodecane, 1,4,7-trisacryloyl-1,4,7-triazaheptane, 1,4,7-trismethacryloyl-1,4,7-triazaheptane, etc.

Suitable examples of addition polymerizable compounds having at least two addition polymerizable bonds include allyl compounds. Specific examples of these compounds include diallyl esters of dicarboxylic acids such as those of phthalic acid, terephthalic acid, sebacic acid, adipic acid, glutaric acid, malonic acid, oxalic acid, etc.; diallyl esters of disulfonic acids such as those of anthraquinone disulfonic acid, benzenedisulfonic acid, 2,5-dihydroxy-p-benzenedisulfonic acid, dihydroxynaphthalenedisulfonic acid, naphthalenedisulfonic acid, etc.; diallyl amides, etc.

Further examples include vinyl ether compounds. Specific examples are polyvinyl ethers of the above-described polyhydric alcohols, e.g., ethylene glycol divinyl ether, 1,3,5-tri-β-vinyloxyethoxybenzene, glycerol trivinyl ether, etc.

Next, examples include vinyl esters. Specific examples are divinyl succinate, divinyl adipate, divinyl phthalate, divinyl terephthalate, divinyl benzene-1,3-disulfonate, divinylbutane-1,4-disulfonate, etc.

Suitable examples additionally are styrene compounds and specific examples thereof include divinyl benzene, p-allylstyrene, p-isopropenestyrene, etc.

Next, esters of itaconic acid and the abovedescribed polyhydric alcohols are suitable. Specific examples include diitaconic acid 1,4-butanediol ester, diitaconic acid ethylene glycol ester, diitaconic acid pentaerythritol ester, triitaconic acid dipentaerythritol ester, pentaitaconic acid dipentaerythritol ester, hexaitaconic acid dipentaerythritol ester, etc.

Further, modified acrylic acid esters, modified methacrylic acid esters, modified itaconic acid esters, acrylated prepolymers, methacrylated prepolymers, itaconylated prepolymers, etc., can be employed. Specific examples include modified diacrylic acid 1,4-butanediol ester, modified triacrylic acid trimethylol propane ester, modified triacrylic acid pentaerythritol ester, methacrylated epoxy prepolymer, acrylated linear polyesters, etc.

Further, compounds having at least two different addition polymerizable unsaturated bonds such as N-β-hydroxyethyl-β-(methacrylamido)ethyl acrylate, N,N-bis(β-methacryloxyethyl)acrylamide, allyl methacrylate, etc., can be used.

Two or more monomers having addition polymerizable unsaturated bond(s) can be employed in combination, if desired. These monomers can be used in a range of from about 0.1 to about 5 parts by weight, preferably 0.3 to 2 parts by weight, based on 1 part by weight of the high molecular weight material binder.

Suitable photopolymerization initiators which are incorporated into the photopolymerizable composition used in the element in accordance with the present invention which can desirably be employed include conventional photopolymerization initiators, such as, for example, carbonyl compounds as described in J. Kosar, *Light-Sensitive Systems*, Chapter 5, nitrogen-containing heterocyclic compounds, organic sulfur compounds, peroxides, redox type compounds, azo and diazo compounds, halogenated compounds, photoreducible dyes, etc. Representative examples include carbonyl compounds such as benzoin, benzoin methyl ether, benzophenone, anthraquinone, 2-methylanthraquinone, 2-ethylanthraquinone, 2-t-butylanthraquinone, 9,10-phenathrenequinone, diacetylbenzyl, and further the compounds represented by the formula:

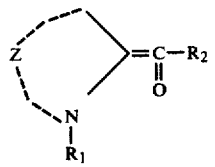

are useful; wherein $R_1$ is an alkyl group generally used in conventional cyanine dyes, e.g., an unsubstituted ($C_1$–$C_4$)-alkyl group such as a methyl group, an ethyl group, a propyl group, etc., a hydroxy($C_1$–$C_4$)alkyl group such as a 2-hydroxyethyl group, etc., a ($C_1$–$C_4$)alkoxy($C_1$–$C_4$)alkyl group such as a 2-methoxyethyl group, etc., a carboxy($C_1$–$C_4$)-alkyl group such as a carboxymethyl group, a 2-carboxyethyl group, etc., a sulfo($C_1$–$C_4$)alkyl group such as a 2-sulfoethyl group, a 3-sulfopropyl group, etc., a ($C_7$–$C_{10}$)aralkyl group such as a benzyl group, a phenethyl group, a p-sulfophenethyl group, a p-carboxyphenethyl group, etc., and a vinylmethyl group and the like are preferred; $R_2$ represents an alkyl group (e.g., a ($C_1$–$C_4$)alkyl group such as a methyl group, an ethyl group, a propyl group, etc., is preferred), an aryl group (e.g., a phenyl group, a p-hydroxyphenyl group, a p-methoxyphenyl group, a p-chlorophenyl group, a naphthyl group, etc., are preferred), or a thienyl group; and Z represents the nonmetallic atoms necessary to form a nitrogen-containing heterocyclic ring which is usually used for conventional cyanine dyes, for example, benzothiazoles (e.g., benzothiazole, 5-chlorobenzothiazole, 6-chlorobenzothiazole, 4-methylbenzothaizole, 6-methylbenzothiazole, 5-phenylbenzothiazole, 5-phenylbenzothiazole, 6-methoxybenzothiazole, 4-ethoxybenzothiazole, 5-methoxybenzothiazole, 5-hydroxybenzothiazole, 5,6-dimethylbenzothiazole, etc.), napthothiazoles (e.g., α-naphthothiazole, β-naphthothiazole, etc.), benzoselenazoles (e.g., benzoselenazole, 5-chlorobenzoselenazole, 6-methylbenzoselenazole, 6-methoxybenzoselenazole, etc.), naphthoselenazoles (e.g., α-naphthoselenazole, β-naphthoselenazole, etc.), benzoxazoles (e.g., benzoxazole, 5-methylbenzoxazole, 5-phenylbenzoxazole, 6-methoxybenzoxazole, etc.), naphthoxazoles (e.g., α-naphthoxazole, β-naphthoxazole, etc.).

Specific examples of compounds represented by the formula above include 2-benzoylmethylene-3-methyl-β-naphthothiazoline, 2-benzoylmethylene-3-ethyl-β-naphthothiazoline, 3-ethyl-2-(2-thenoyl)methylene-β-naphthothiazoline, 3-ethyl-2-propionylmethylene-β-naphthothiazoline, 5-chloro-3-ethyl-2-p-methoxybenzoylmethylenebenzothiazoline, etc.

Typical examples of nitrogen-containing heterocyclic compounds include acridine derivatives such as 9-phenylacridine, 9-p-methoxyphenylacridine, 9-acetylaminoacridine, benz[a]acridine; phenazine derivatives, such as 9,10-dimethylbenz[a]phenazine, 9-methylbenz[a]phenazine; quinoxaline derivatives such as 6,4′,4″-trimethoxy-2,3-diphenylquinoxaline, 4′,4″-dimethoxy-2,3-diphenyl-5-azaquinoxaline; quinazoline derivatives such as 2-methylquinazoline, 4-phenylquinazoline, etc.; imidazole derivatives such as 2,4,5,2′,4′,5′-hexaphenyl-1,1′-biimidazole, 2,2′-bis(o-chlorophenyl)-4,5,4′,5′-tetraphenyl-1,1′-biimidazole, 2,2′-bis(p-methylthiophenyl)-4,5,4′,5′-tetraphenyl-1,1′-biimidazole, etc. Specific examples of organic sulfur compounds include di-n-butyl disulfide, di-n-octyl disulfide, dibenzyl disulfide, diphenyl disulfide, diacetyl disulfide, 2-mercaptobenzothiazole, 2-mercaptobenzoxazole, 2-mercaptobenzimidazole, thiophenol, thiocresol, p-methoxybenzenethiol, carboxymethyl-N,N-dimethyldithiocarbamate, ethyl trichloromethanesulfonate, etc. Specific examples of peroxides are hydrogen peroxide, di-t-butyl peroxide, benzoyl peroxide, methyl ethyl ketone peroxide, etc.

A redox type compound comprises the combination of a peroxide and a reducing agent. Examples of suitable combinations are iron (II) ions and hydrogen peroxide, iron (II) ions and persulfate ions, iron (III) ions and hydrogen peroxide, iron (III) ions and persulfate ions, etc.

Specific examples of azo and diazo-compounds include diazonium salts of α,α′-azobisisobutyronitrile, 2-azobis-2-methylbutyronitrile, 1-azobiscyclohexanecarbonitrile, p-aminodiphenylamine, etc.

Specific examples of halogenated compounds are chloromethyl naphthyl chloride, phenacyl chloride, chloroacetone, β-naphthalene sulfonyl chloride, xylenesulfonyl chloride, etc.

The compounds described above can be employed individually or as a combination of two or more compounds as a photopolymerization initiator. A suitable amount of the photopolymerization initiator ranges from about 0.1 to about 20 parts by weight, preferably 0.5 to 10 parts by weight, based on 100 parts by weight of the addition polymerizable monomer.

The photopolymerizable composition which is used in accordance with the present invention contains the above-described components. In addition, preferably the composition also contains a thermal polymerization inhibitor. Specific examples of the thermal polymerization inhibitors include p-methoxyphenol, hydroquinone, an alkyl- or aryl-substituted hdyroquinone, t-butylcatechol, chloranil, naphthyl amine, β-naphthol, 2,6-di-t-butyl-p-cresol, pyridine, nitrobenzene, dinitrobenzene, p-toluidine, methylene blue, an organic acid copper salt (e.g., copper acetate, etc.), and the like. These thermal polymerization inhibitors are preferably employed in an amount of about 0.001 to about 5 parts by weight per 100 parts by weight of the addition polymerizable monomer.

In addition, various additives such as coloring agents, plasticizers, resins, and the like can also be incorporated in the photopolymerizable light-sensitive resin composition which is used in the element of the present invention. Typical examples of coloring agents are, for example, pigments such as titanium oxide, carbon black, iron oxides, phthalocyanine type pigments, azo type pigments, etc., dyes such as methylene blue, crystal violet, rhodamine B, fuchsine, auramine, azo type dyes, anthraquinone type dyes, etc. Preferred coloring agents are those which do not absorb light at the absorption wavelength of the photopolymerization initiator. Such a coloring agent can be employed in an amount of about 0.1 to about 30 parts by weight in the case of pigments and in an amount of about 0.01 to about 10 parts by weight in the case of dyes, preferably in an amount of 0.1 to 3 parts by weight in both cases, based on the total amount, 100 parts by weight, of the binder and the addition polymerizable monomer. Preferably, the plasticizers (or the resin) are added in an amount of from about 0.01 to about 20 parts by weight per 100 parts by weight of the total weight of the binder and monomers.

Specific examples of suitable plasticizers include phthalic acid esters such as dimethyl phthalate, diethyl phthalate, dibutyl phthalate, diisobutyl phthalate, diheptyl phthalate, dioctyl phthalate, octylcapryl phthalate, dicyclohexyl phthalate, ditridecyl phthalate, butylbenzyl phthalate, diisodecyl phthalate, diallyl phthalate, etc.; glycol esters such as dimethylglycol phthalate, ethylphthalylethyl glycolate, methylphthalylethyl glycolate, butylphthalylbutyl glycolate, triethyleneglycol dicaprylic acid ester, etc.; phosphoric acid esters such as tricresyl phosphate, triphenyl phosphate, etc.; aliphatic dicarboxylic acid esters such as diisobutyl adipate, dioctyl adipate, dimethyl sebacate, dibutyl sebacate, dihexyl azelate, etc., triethyl citrate, tributyl citrate, glycerin triacetate, butyl laurate, 4,5-diepoxycyclohexane-1,2-dicarboxylic acid di-2-ethylhexyl ester, etc.

The photopolymerizable composition which is used in accordance with the present invention is dissolved in a suitable solvent to obtain a light-sensitive composition solution, which is coated onto a hydrophilic support used in accordance with the present invention, followed by drying. In general, a suitable coating amount of the photopolymerizable composition after removing the solvent ranges from about 0.5 $g/m^2$ to about 150 $g/m^2$, preferably 0.7 $g/m^2$ to 30 $g/m^2$, most preferably 1 $g/m^2$ to 10 $g/m^2$.

Specific examples of suitable solvents for the coating solution include ketones such as acetone, methyl ethyl ketone, methyl isobutyl ketone, cyclohexanone, diisobutyl ketone, etc., esters such as ethyl acetate, butyl acetate, namyl acetate, methyl formate, ethyl propionate, dimethyl phthalate, ethyl benzoate, etc., aromatic hydrocarbons such as toluene, xylene, benzene, ethylbenzene, etc., halogenated hydrocarbons such as carbon tetrachloride, trichloroethylene, chloroform, 1,1,1-trichloroethane, monochlorobenzene, chloronaphthalene, etc., ethers such as tetrahydrofuran, diethyl ether, ethylene glycol monomethyl ether, ethylene glycol monoethyl ether acetate, etc., dimethyl formamide, dimethylsulfoxide, etc.

For the cover film for peeling-apart which is used in the element of the present invention, the transmittance of light must be good and the surface must be uniform. With respect to the transmittance of light, the % transmission must be greater than about 50% in the near ultraviolet region and visible region (about 290 nm to about 600 nm in wavelength), preferably greater than 65%.

Specific examples of suitable materials which can be employed for the cover film are cover films of various kinds of synthetic resins such as a polyethylene terephthalate, polypropylene, polyethylene, cellulose triacetate, cellulose diacetate, polyvinyl chloride, polyvinyl alcohol, polycarbonate, polystyrene, cellophane films made from regenerated cellulose, polyvinylidene chloride copolymers, polyamides, polyimides, vinyl chloride-vinyl acetate copolymers, polytetrafluoroethylene, polytrifluoroethylene, etc. In addition, composite materials comprising two or more of the above-described films can be used. A polyethylene terephthalate film is most preferred as a cover film.

In general, a suitable thickness for the cover film ranges from about 5 μm to about 100 μm, preferably 10 μm to 40 μm.

The thickness of the above-described light-sensitive composition layer which is used in the element of the present invention is determined such that the finally formed image for lithographic printing areas may meet their desired use/function. In general, the thickness of the light-sensitive composition layer after removing the solvent preferably ranges from about 0.5 μm to about 100 μm, more preferably 0.5 μm to 20 μm, most preferably 1 μm to 5 μm.

The light-sensitive lithographic printing plate element of the present invention is obtained by a process which comprises providing a layer of a photopolymerizable composition on a hydrophilic support which is treated with a water soluble oxygen acid or a salt thereof and then providing further thereon the above-described cover film (a sheet for peeling-apart development) under pressure. It is also possible to use a cover film having thereon a layer of the photopolymerizable composition and then laminating the cover flim under pressure onto the hydrophilic support which is treated with a water soluble oxygen acid or a salt thereof so that the layer of the photopolymerizable composition contacts the hydrophilic layer.

The thus obtained light-sensitive printing plate is imagewise exposed through an original film.

Suitable light sources for imagewise exposure which can be used are those providing light with a wavelength of about 350 to about 450 nm, e.g., a high pressure mercury lamp, a xenon lamp, a carbon arc lamp, a fluorescent lamp for copying, etc. In addition, laser rays, electron beams, and X-rays can also be employed as a source of irradiation.

After imagewise exposure, the cover film (peeling-apart sheet) is peeled-apart so that either one of the exposed areas or the unexposed areas on the light-sensitive layer remains on the support and the other one remains on the cover film, whereby a negative image and a positive image (or vice versa) are formed on the support and on the cover film, respectively.

The element of the present invention is a material which can be used to prepare a lithographic printing plate. Naturally and it is needless to say, the element of the present invention is suitable for use as an image copying element in which the image per se obtained by treating the element of the present invention is used.

In the materials of this invention, in the case where the images obtained by peeling-apart development are not sufficiently provided with the strength, hardness, oleophilicity, etc., necessary for use as a lithographic printing plate, a method in which polymerization and hardening are further achieved by irradiation with actinic radiation of light (ultraviolet or visible light) or heat, a method in which the oleophilicity is strengthened and the strength is increased by the application of lacquer, gum solution, and the like, or like known post-treatments can be used.

Typical examples of hydrophilic high molecular weight materials which can be incorporated in an aqueous solution of the hydrophilic high molecular weight material which is a so-called gum solution are carboxymethyl cellulose, carboxyethyl cellulose, ethylhydroxyethyl cellulose, ethylmethyl cellulose, hydroxymethyl cellulose, hydroxyethyl cellulose, hydroxypropyl cellulose, etc.; partial esters, partial ethers and partial acetals of polyvinyl alcohol which contain an unsubstituted vinyl alcohol unit in an amount sufficient to provide water solubility; polyvinyl pyrrolidone, vinyl methyl ether-maleic anhydride copolymers, styrene-maleic anhydride copolymers, vinyl acetate-maleic anhydride copolymers, polyvinyl acetate hydrolyzed to an extent of about 88 to 99%, polyacrylamide, gelatin, modified gelatins, gum arabic, dextran, inulin, mannan, pectin, soluble starch and a mixture of two or more above-described compounds, etc. A 2 to 10 wt% aqueous solution of these compounds can be used as a gum solution. If necessary, the above-described aqueous solution can contain acidic materials such as phosphoric acid, magnesium nitrate, etc.

The present invention is explained in greater detail by reference to the examples hereinbelow. Unless otherwise indicated herein, all parts, percents, ratios and the like are by weight.

EXAMPLE 1

A lithographic 2 S type aluminum plate which was mechanically grained was immersed in a 2 wt% sodium hydroxide aqueous solution which was kept at 40° C. for 1 minute to partially etch the surface thereof. After washing the surface with water, the plate was immersed in a sulfuric acid-chromic acid mixture for about 1 minute to expose a surface of pure aluminum. Thereafter, the plate was immersed in a 20% sulfuric acid aqueous solution which was kept at 30° C. and anodically oxidized for 2 minutes under a direct current voltage of 15 V and an electric current density of 3 A/dm$^2$.

Then, Aluminum Plates A to G obtained in this manner were immersed in an aqueous solution of a water soluble oxygen acid salt as indicated in Table 1 below at the respective temperatures for the respective time periods as indicated in Table 1 below, respectively, to surface treat the plates. Thus, Supports A to G were obtained.

On the other hand, a support which was subjected only to the above-described anodic oxidation followed by washing with water, Support H, was produced as a comparative sample.

TABLE 1

| Aluminum Plate | Aqueous Oxygen Acid Salt Solution: Compound | Concentration (wt %) | Temperature (°C.) | Immersion Period of Time (sec) |
|---|---|---|---|---|
| A | Sodium silicate* | 2.0 | 50 | 40 |
| B | Potassium molybdate | 2.5 | 40 | 60 |
| C | Ammonium borate | 1.5 | 40 | 60 |
| D | Potassium metaborate | 2.0 | 60 | 30 |
| E | Sodium polymetaphosphate | 2.0 | 45 | 60 |
| F | Ammonium tungstate | 1.5 | 60 | 60 |
| G | Potassium chromate | 0.5 | 40 | 40 |

*$SiO_2$:$Na_2O$ = 3:1 (molar ratio)

Separately, a solution of a light-sensitive composition was prepared by dissolving the following components in a mixed solvent of 100 ml of methyl ethyl ketone and 20 ml of dimethyl formamide.

| | |
|---|---|
| Chlorinated Polyethylene (Superchlon CPE-907LTA*, trade name, made by Sanyo Kokusaku Pulp Co., Ltd.) | 10 g |
| Pentaerythritol Trimethacrylate | 10 g |
| 2-Methylanthraquinone | 0.2 g |
| Hydroquinone | 0.1 g |

-continued

| | |
|---|---|
| Copper Phthalocyanine Pigment | 0.2 g |

*Superchlon CPE-907LTA has a viscosity of about 90 cps at 25° C. in a 40 wt % toluene solution and has a chlorine content above 66 wt %.

The light-sensitive solution was coated onto the surface of Supports Plates A to H, respectively, with a rotary coating machine (the thickness of the coated layer was 4 μm after the solvent was removed from the light-sensitive layer). After drying at 80° C. for 7 minutes, a polyethylene terephthalate film having a thickness of 20 μm was further laminated on the light-sensitive layers under pressure to prepare light-sensitive Lithographic Printing Plates A through G and H, respectively. All of the light-sensitive lithographic printing plates A through H were stored in the dark for 7 months (the temperature varied within a range of from about 20° C. to about 30° C. and the humidity varied in a range from about 35% to about 80% RH). Thereafter, the respective printing plates were imagewise exposed through a negative film at a distance of 1 m for 17 seconds using a PS light S type (metal halide lamp, 2 kw). Immediately after the imagewise exposure, the polyethylene terephthalate film was peeled off so that, in the light-sensitive Lithographic Printing Plates A through G, a positive image which was photohardened was formed on the aluminum plate and on the other hand, the unhardened areas (unexposed areas) were removed together with the polyethylene terephthalate film, respectively. In light-sensitive Lithographic Printing Plate H, however, a positive image which was photohardened was obtained, but the unexposed areas (non-image areas) to be removed partially remained on the surface of the aluminum plate.

Then, after these lithographic printing plates were treated by coating thereon an aqueous solution of gum arabic (solution of 5 g of gum arabic in 100 ml of water), the lithographic printing plates were inserted in a printing machine (Davidson Dualith 700) and printing was conducted by offset printing under the same conditions. The results obtained are shown in Table 2 below.

TABLE 2

| Light-Sensitive Printing Plate | Scum on Plate | Scum on Printed Material |
|---|---|---|
| A | O | O |
| B | O | O |
| C | O | O |
| D | O | O |
| E | O | O |
| F | O | O |
| G | Δ | O |
| H | X | X |

The terms "scum on plate" and "scum on printed material" in Table 2 above mean the appearance of the plate in the non-image areas and that of the printed material, respectively, after printing 5,000 sheets each. The results shown for Printing Plate H, however, are those obtained after printing 500 sheets rather than 5,000 sheets. In Table 2 above, the symbols each means:

o: Practical (no problems)

Δ: Somewhat inferior but practically usable x: Not practical

EXAMPLE 2

An aluminum plate having a thickness of 0.3 mm was degreased by immersion in a 7% sodium phosphate aqueous solution to 80° C. for 3 minutes. After washing the plate with water, the aluminum plate was sand-grained by rubbing and plate surface a nylon brush while flowing a dispersion of fine pumice particles in water thereover. Thereafter, the aluminum plate was sufficiently washed with water and then immersed for 1 minute in a 5 wt% aqueous solution of JIS No. 3 sodium silicate ($SiO_2/Na_2O=3.1-3.3$ molar ratio) which was kept at 75° C. After sufficiently washing the plate with water and drying the plate, a solution having the composition as indicated below was coated on the aluminum plate in a thickness of 5 g/m$^2$ on a dry basis. After drying the coating, a polyethylene terephthalate film having a thickness of 18 μm was further laminated thereon under a pressure of about 5 kg/cm$^2$ to produce a light-sensitive lithographic printing plate.

| | |
|---|---|
| 1-2-Dichloroethane | 160 g |
| Chlorinated Polyethylene (Elasren-401A*, trade name, made by Showa Denko Co., Ltd.) | 15 g |
| Diglycerin Trimethacrylate | 25 g |
| 1-Methyl-2-benzoylmethylene-β-naphthothiazine | 0.3 g |
| p-Methoxyphenol | 0.2 g |
| Copper Phthalocyanine Pigment | 0.1 g |

*Elasren-401A has a chlorine content of 40%, a specific gravity of 1.20 and a Mooney viscosity of 80.

Then, this light-sensitive printing plate was divided into two pieces. One piece was stored in the dark (the temperature varied over a range of from about 20 to about 30° C. and the humidity varied over a range of from about 35 to about 80% RH) for a period of 6 months (Sample A), and the other was stored at 40° C. in the dark for a period of 5 weeks without controlling humidity to perform an accelerated ageing test (Sample B).

Both Sample A and Sample B were exposed by closely contacting a transparent negative original with the polyethylene terephthalate film for 20 seconds through the negative original and the polyethylene terephthalate film at a distance of 70 cm from an arc lamp utilizing an electric current of 35 Amperes (ca. 35 kw). Then, the polyethylene terephthalate film was peeled apart so that the exposed hardened areas alone remained on the aluminum support. Thereafter, the surface of the aluminum support on which an image was formed was rubbed softly with a cellulose sponge having applied thereto a developing ink having the composition as indicated below.

| Composition of Developing Ink | |
|---|---|
| Transfer Ink | 35 g |
| Asphalt | 8 g |
| Marseille Soap | 9 g |
| Oleic Acid | 9 g |
| Terpentine Oil | 870 g |
| Benzene | 260 g |

By the treatments as above-described lithographic printing plates were produced. The lithographic printing plates prepared from Sample A and Sample B both had good hydrophilic surfaces which were readily receptive to water and held water thereon well since the layer of the light-sensitive composition at the unexposed areas was removed together with the polyethylene terephthalate film to completely expose the layer containing the hydrophilic oxygen acid salts. On the other hand, the layer of the light-sensitive composition hardened at the exposed areas was strongly adhered to the layer containing the hydrophilic organic high molecular weight material so that the lithographic printing plates were sufficiently oleophilic that a printing ink adhered thereto well. In this example, it was difficult to discern a difference as lithographic printing plates between Sample A and Sample B, which demonstrated that storability with the passage of time was excellent with the light-sensitive lithographic printing plates in accordance with the present invention.

EXAMPLE 3

A 3S type aluminum plate for lithography was immersed in a 3% sodium hydrogencarbonate aqueous solution at 60° C. for 1 minute in order to remove an oil layer adhered to the surface thereof upon rolling and cleaning. The aluminum plate was then washed with water sufficiently. This aluminum plate was divided into three equal portions, which were designated 3-A, 3-B, and 3-C, respectively.

Aluminum plate 3-B was subsequently immersed in a 3 wt% sodium molybdate aqueous solution (70° C.) for 2 minutes, followed by washing with water.

Aluminum plate 3-C was immersed in a 2.5 wt% sodium silicate aqueous solution (60° C.) for 2 minutes, followed by washing with water.

Aluminum plate 3-A was not subjected to such a surface treatment using an aqueous solution of water soluble oxygen acid salts.

A solution of the light-sensitive photopolymerizable composition as shown below was coated on the above-produced 3 kinds of aluminum base plates, respectively, followed by drying.

| | | |
|---|---|---|
| Chlorinated Polypropylene (Superchlon CPP-306*, trade name manufactured by Sanyo Kokusaku Pulp Co., Ltd.) | 20 | g |
| Trimethylol Propane Triacrylate | 30 | g |
| 2-t-Butylanthraquinone | 0.4 | g |
| Methylene Blue | 0.2 | g |
| p-Methoxyphenol | 0.1 | g |
| 1,2-Dichloroethane | 140 | g |
| Toluene | 60 | g |

*Superchlon CPP-306 has a viscosity of about 120 cps in a 40 wt % toluene solution at 25° C. and a chlorine content of greater than 66 wt %.

The thickness of each of the light-sensitive layers coated on the three aluminum plate was 3.4 μm after drying. On the respective light-sensitive layers of the three aluminum plates, a film of moisture-proof cellophane (KM Cellusi No. 300, trade name, manufactured by Daisel Co., Ltd). was further laminated thereon under a pressure of about 3.6 kg/cm$^2$ to prepare light-sensitive lithographic printing plate elements, respectively. These light-sensitive lithographic printing plates were stored at 40° C. in the dark without controlling the humidity to perform an accelerated ageing test. The printing plates were taken out after 3 days, 1 week, 3 weeks and 2 months, and were subjected to the same treatments as described in Example 1 to obtain lithographic printing plates, respectively.

As a result of printing by placing the thus obtained printing plates in a printing machine (HEIDERBERG SORK-Z), the degree of scumming at the non-image areas is shown in Table 3 below.

TABLE 3

| Lithographic Printing Plate | Accelerated Ageing Test | | | |
|---|---|---|---|---|
| | 3 Days | 1 Week | 3 Weeks | 3 Months |
| 3-A | O | Δ | X | X |
| 3-B | O | O | O | O |
| 3-C | O | O | O | O |

The degree of scumming at the non-image areas of the printing plates in an appearance after printing 5,000 sheets, respectively. With printing plate 3-A, the results are shown after printing 500 sheets. In the table above, the symbols represents:

o: Good printed materials are obtained without any scum on the printed materials.

Δ: Some scum is formed.

x: Scumming is serious and the plate is not practically usable.

As is shown in Table 3 above, no ink scum on the plates and no scum on the printed materials occurred in the light-sensitive lithographic printing plates using supports 3-B and 3-C which had been subjected to the immersion treatment with the oxygen acid salt aqueous solutions after the accelerated ageing test and as a result, superior printed materials were obtained.

On the other hand, in the light-sensitive lithographic printing plate obtained using support 3-A which was not immersion-treated with an oxygen acid salt aqueous solution, much scum and smudging were formed on the non-image areas obtained by imagewise exposure and peeling-apart development under the same conditions and a printing ink for lithography adhered to the non-image areas of the plate and scum were observed also on the printed materials, which made it clear that the printing plate was not practically usable.

EXAMPLE 4

A 2S type aluminum plate having a thickness of 0.3 mm, whose surface was not grained, was immersed for 30 seconds in a 5 wt% sodium hydrogencarbonate aqueous solution (washing solution) of 50° C. The aluminum plate was washed by spraying thereon warm water at 40° to 50° C. Then, the aluminum plate was immersed in an 8% ammonium hydrogen fluoride aqueous solution (23° C.) for 1 minute. The aluminum plate was washed with warm water again to remove stains and an oil layer present on the surface of the aluminum plate. Then, the aluminum plate was subjected to anodic oxidation in accordance with the following method. Three aluminum plates produced as described above were immersed at 25° C. in a tank containing a 12% sulfuric acid aqueous solution and were subjected to anodic oxidation using the aluminum plate as an anode. In this case, a lead plate having the same size was used as a cathode. An electric current was employed in a density of 21.5 A/dm$^2$ for 90 seconds. The anodically oxidized aluminum plates were removed from the bath and washed with water at room temperature (23° C.) thoroughly, followed by drying. The results of analysis of the layer, which surface was subjected to anodic oxidation, indicated that aluminum sulfate at about 140 mg/m$^2$ was present. It was found from an examination using an electromicroscope that the size of the pores of the layer anodically oxidized was less than 50 Å. Of the three aluminum plates, two (which were designated Support X and Support Y) were further immersion-treated with aqueous solutions of oxygen acid salts as indicated in Table 4 below.

TABLE 4

| Aluminum Plate Support | Aqueous Solution of Oxygen Acid Salt | | | Immersion Time (sec) |
|---|---|---|---|---|
| | Compound | Concentration (wt %) | Temperature (°C.) | |
| X | Potassium metaborate | 1.5 | 70 | 60 |
| Y | Sodium hexametaphosphate | 2.5 | 60 | 90 |

After the treatment, the aluminum plates were thoroughly washed with water, followed by drying. The remaining aluminum plate was not immersion treated with an aqueous solution of an oxygen acid salt (which was designated Support Z).

On these supports, a light-sensitive photopolymerizable composition similar to that described in Example 1 was coated as a toluene solution thereof using roller coating, followed by drying at 100° C. for 3 minutes. A polypropylene film having a thickness of 30 μm was laminated thereon under a pressure of about 3.1 kg/cm$^2$ to produce light-sensitive printing plates. The coating amount of the light-sensitive layer was 5.2 g/m$^2$ in each case. These light-sensitive lithographic printing plates were stored for 4 months in the dark (the temperature varied over a range of from about 20° C. to about 30° C. and the humidity varied over a range of about 35% to about 80% RH). Thereafter, lithographic printing plates were prepared in a manner similar to that described in Example 1. After printing, the results as shown in Table 5 below were obtained.

TABLE 5

| Lithographic Printing Plate | Scum and Smudge at Non-Image Areas | Scumming on Plate | Scumming on Printed Material |
|---|---|---|---|
| Support X | None | None | None |
| Support Y | None | None | None |
| Support Z | Formed | Formed | Formed |

EXAMPLE 5

A JIS second type zinc plate for lithography (thickness of 0.35 mm) was ball-grained with Carborundum No. 180 having a particle size of about 0.083. All trace of graining material was thoroughly removed with a strong jet of water. The zinc plate was subjected to a surface counter-etching treatment with the following weakly acidic surface counter-etch solution (for zinc) for 1 minute, followed by thoroughly washing the plate with water and drying.

| Surface Counter-Etch Solution | |
|---|---|
| Hydrochloric Acid (38 wt % aq. soln.) | 8 ml |
| Water | 1,000 ml |

The thus treated zinc plate was divided into four portions. Of these, three zinc plates were treated as indicated in Table 6 below (which were designated Supports 5-A, 5-B and 5-C, respectively). The remaining plate was subjected only to the surface counter-etching treatment, water washing and drying (which was designated Support 5-D).

TABLE 6

| Zinc Plate Support | Aqueous Solution of Oxygen Acid Salt: Compound | Concentration (wt %) | Temperature (°C.) | Immersion Time (seconds) |
|---|---|---|---|---|
| 5-A | Sodium pyrophosphate | 2.0 | 65 | 60 |
| 5-B | Potassium molybdate | 2.5 | 70 | 90 |
| 5-C | Metavanadic acid | 1.5 | 60 | 90 |

Thereafter, light-sensitive lithographic printing plates using these four zinc plates were prepared in a manner similar to that described in Example 2. After the light-sensitive lithographic printing plates were stored for 2 months in the dark in which the temperature varied over a range of from about 25° to about 33° C. and the humidity varied over a range of from about 40 to about 80% RH (weather conditions in summer), the light-sensitive lithographic printing plates were treated in a manner similar to that described in Example 1 to prepare lithographic printing plates. The thus obtained lithographic printing plates were employed for printing. In the case of using the lithographic printing plates obtained using Supports 5-A, 5-B and 5-C no scum was formed on the plates nor were the printed materials scummed. However, in the case of using the lithographic printing plate obtained using Support 5-D, scum was formed on the plate and scum appeared also on the printed materials, which could not be practically used.

EXAMPLE 6

An anodically oxidized aluminum plate was immersed for 60 seconds in a 2 wt% aqueous disodium hydrogen phosphate solution at 68° C. and then washed with water and further immersed for 60 seconds in a 2 wt% aqueous sodium silicate solution at 60° C., followed by drying. Otherwise, the procedures were the same as in Example 1. Excellent printed materials were obtained and no scum was formed on the surface of the lithographic printing plate, as in the cases of Supports A through G in Example 1.

EXAMPLE 7

Three aluminum plates (7-A, 7-B and 7-C), each of which was machanically grained and anodically oxidized in the same manner as described in Example 1, were washed with water and then immersed in a phosphoric acid aqueous solution at the temperatures and concentrations and for the time periods as indicated in Table 7 below. The resulting aluminum plates were washed with water and then immersed in a sodium silicate aqueous solution at the temperatures and concentrations and for the time periods as also indicated in Table 7 below, followed by thoroughly washing the plates with water and drying the plates.

TABLE 7

| Aluminum Plate | Phosphoric Acid Aqueous Solution: Concentration (wt %) | Temperature (°C.) | Immersion Time (sec) | Sodium Silicate Aqueous Solution: Concentration (wt %) | Temperature (°C.) | Immersion Time (sec) |
|---|---|---|---|---|---|---|
| 7-A | 3 | 65 | 40 | 2 | 60 | 60 |
| 7-B | 6 | 69 | 27 | 2 | 70 | 40 |
| 7-C | 2 | 72 | 60 | 3 | 60 | 60 |

Thereafter, light-sensitive lithographic printing plates (7-A, 7-B and 7-C) using the thus treated three aluminum plates were prepared in a manner similar to that described in Example 1. The imagewise exposure and subsequent procedures similar to those used in Example 1 were carried out using these printing plates to effect printing. After printing 5,000 sheets, no scumming was formed on the plates and printed materials, which could be practically used.

EXAMPLE 8

An aluminum plate anodically oxidized in the same manner as described in Example 4 was immersed in a 1.5 wt% phosphoric acid aqueous solution at 68° C. for 60 seconds. After thoroughly washing with water, the aluminum plate was immersed in a 2 wt% sodium silicate aqueous solution at 70° C. ($SiO_2/Na_2O$ molar ratio: 3.1 to 3.3) for 60 seconds, followed by thoroughly washing the plate with water and drying the plate. A light-sensitive photopolymerizable composition similar to that described in Example 2 was coated on the aluminum plate in a thickness of 5.5 g/m$^2$ on a dry basis. After drying the coating, a polyethylene terephthalate film having a thickness of 12 μm was further laminated thereon under a pressure of about 3.5 kg/cm$^2$ to produce a light-sensitive lithographic printing plate.

Then, the thus obtained printing plate was stored in the dark (the temperature varied over a range of from about 20° to about 30° C. and the humidity varied over a range of from about 35 to about 80% RH) for a period of 4 months. Thereafter, a lithographic printing plate was prepared, followed by using such for printing. After printing 5,000 sheets, no scum and smudge at the non-image areas, no scumming on the plate, and no scumming on the printed material were formed.

While the invention has been described in detail and with reference to specific embodiments thereof, it will be apparent to one skilled in the art that various changes and modifications can be made therein without departing from the spirit and scope thereof.

What is claimed is:

1. In a process for preparing a lithographic printing plate which comprises (1) preparing a light-sensitive lithographic printing plate precursor comprising a metal support having thereon, in succession, a light-sensitive composition layer and a transparent film, said light-sensitive composition layer having a stronger adhesion to one of said support and said film than the other one in its unexposed state and having a stronger adhesion to said the other one than said one in its exposed state, by coating said light-sensitive composition layer on said support and then placing said transparent film over said light-sensitive composition layer and thereafter (2) imagewise exposing said precursor and (3) peeling said imagewise exposed precursor apart to remove, together with said film, areas which have a stronger adhesion to said film in said imagewise exposed light-sensitive composition layer by utilizing the difference in adhesion to said support and to said film between the exposed areas and the unexposed areas of said light-sensitive composition layer, whereby to obtain the lithographic printing plate, the improvement which comprises prior to said coating, subjecting the surface of said support to be adjacent said light-sensitive composition layer to an anodic oxidation treatment and then treating said surface successively with (1) an aqueous solution containing phosphoric acid, and (2) an aqueous solution containing at least one water soluble silicic acid or salt thereof selected from the group consisting of a silicic acid or silicic acid salt and then coating the treated surface with said light-sensitive composition layer.

2. The process as claimed in claim 1, wherein said aqueous solution of said phosphoric acid has a concentration ranging from about 0.01% to about 2.5% by weight.

3. The process as claimed in claim 1, wherein said silicic acid and said silicic acid salt are selected from the group consisting of orthosilicic acid and a silicate represented by the formula:

$$L_2O.zSiO_2$$

wherein L is Li, Na, K, $NH_4$, $N(CH_2OH)_4$ or $N(C_2H_4OH)_4$, and z is positive and ranges from 0.2 to 9.0.

4. The process as claimed in claim 1, wherein each of said treatments with said aqueous solutions (1) and (2) is at a temperature of from about 20° C. to about one degree less than the boiling temperature of said aqueous solution and for a period of from about 5 seconds to about 5 minutes.

5. The process as claimed in claim 1, wherein said element has been washed with water between said treatment (1) and said treatment (2).

6. The process as claimed in claim 1, wherein said aqueous solution of phosphoric acid has a concentration ranging from about 0.01% to about 10% by weight, and said aqueous solution of at least one water soluble silicic acid or salt thereof has a concentration ranging from about 0.01% to about 10% by weight.

7. The process as claimed in claim 1, wherein said phosphoric acid is orthophosphoric acid or metaphosphoric acid.

8. The process as claimed in claim 1, wherein each of said aqueous solutions (1) and (2) has a concentration of at least about 0.01% by weight.

9. The process as claimed in claim 5, wherein said aqueous solution of phosphoric acid has a concentration ranging from about 0.01% to about 10% by weight, and said aqueous solution of at least one water soluble silicic acid or salt thereof has a concentration ranging from about 0.01% to about 10% by weight.

10. The process as claimed in claim 1, wherein said light-sensitive composition is a photopolymer.

11. The process as claimed in claim 10, wherein said photopolymer comprises an organic high molecular weight material as a binder, a monomer having at least one addition polymerizable ethylenically unsaturated bond and a photopolymerization initiator.

12. The process as claimed in claim 11, wherein said organic high molecular weight material is a polymer having a molecular weight of about 5,000 to about 2,000,000.

13. The process as claimed in claim 12 wherein said polymer is selected from the group consisting of chlorinated polyolefin and polyvinyl butyral.

14. The process as claimed in claim 12, wherein said monomer is at least one selected from the group consisting of di- and higher-acrylates and polyhydric alcohol and di- and higher-methacrylates of polyhydric alcohol.

* * * * *